US007192010B2

(12) United States Patent
Roodenburg et al.

(10) Patent No.: US 7,192,010 B2
(45) Date of Patent: Mar. 20, 2007

(54) ROLLERCOASTER LAUNCH SYSTEM

(75) Inventors: Joop Roodenburg, Delft (NL); Peter De Vin, Rijswijk (NL)

(73) Assignee: Vekoma Rides Engineering B.V. (NL)

( * ) Notice: Subject to any disclaimer, the term of this patent is extended or adjusted under 35 U.S.C. 154(b) by 334 days.

(21) Appl. No.: 10/966,802

(22) Filed: Oct. 15, 2004

(65) Prior Publication Data

US 2005/0045861 A1 Mar. 3, 2005

Related U.S. Application Data

(62) Division of application No. 10/195,295, filed on Jul. 15, 2002, now Pat. No. 6,837,166.

(51) Int. Cl.
*B66D 1/10* (2006.01)

(52) U.S. Cl. ..... 254/360; 254/361; 104/55; 104/63; 60/371

(58) Field of Classification Search ..... 254/360, 254/361; 104/53, 63; 60/371
See application file for complete search history.

(56) References Cited

U.S. PATENT DOCUMENTS 3,793,834 A * 2/1974 Martin ..... 60/413
4,047,311 A * 9/1977 Kelley ..... 37/309
4,187,681 A * 2/1980 Johnson ..... 60/395
4,191,016 A 3/1980 Roth ..... 60/371
4,223,871 A * 9/1980 Braithwaite ..... 254/291
4,240,613 A * 12/1980 Braithwaite ..... 254/315
4,703,835 A 11/1987 Negrutsky ..... 187/17
6,371,447 B1 * 4/2002 Imanishi et al. ..... 254/361
6,439,129 B2 8/2002 Begotti ..... 104/63
6,644,629 B1 * 11/2003 Higashi et al. ..... 254/361
6,648,303 B1 * 11/2003 Nishimoto et al. ..... 254/361
6,679,182 B2 1/2004 Spieldiener ..... 104/53

FOREIGN PATENT DOCUMENTS

WO WO 02/14199 2/2002

* cited by examiner

*Primary Examiner*—Emmanuel M Marcelo
(74) *Attorney, Agent, or Firm*—Buskop Law Group, PC; Wendy K. Buskop

(57) ABSTRACT

A winch system, typically used in a roller coaster system, includes a hydraulic pump, a variable speed motor connected to the hydraulic pump, a first pipe connected to the hydraulic pump; a second pipe connected to the hydraulic pump comprising a second pressurized fluid; an accumulator system connected the pipes; a motor connected to the accumulator system; and a winch drum connected to the motor.

19 Claims, 10 Drawing Sheets

ROLLERCOASTER LAUNCH SYSTEM

The present application is a divisional of U.S. patent application Ser. No. 10/195,295 filed on Jul. 15, 2002 now U.S. Pat. No. 6,837,166.

FIELD

The present embodiments relate to a rollercoaster launching system and booster system with an increased efficiency as to lower the maximum power of the launching system.

The present embodiments also relate to a method for both launching and stopping the rollercoaster carts.

BACKGROUND OF THE INVENTION

In general, rollercoasters are useful amusement park devices comprised of a car supported in a frame that causes the cart to follow a path where the rider experiences high speeds and gravitational forces due to loops, turns and drops. In conventional rollercoasters the carts are pulled to the top of a ramp to provide the carts with the energy needed to complete the ride. During the ride the carts convert the gained potential energy into kinetic energy i.e. speed.

Since the potential energy is dependent on the height of the ramp a higher ramp makes a longer track or higher speeds possible. The height of this ramp cannot be increased without considerably costs. Also constructional problems and environmental issues limit the height of this ramp. Another possibility of giving the carts enough energy to complete the ride is to accelerate the carts at the start of the ride adding directly kinetic energy to the carts. One of the advantages of this method of launching is that a ramp is not needed anymore thus making a smaller construction possible. Another advantage is that more exciting loops and turns can be incorporated into the rollercoaster because the kinetic energy that is given to the carts at the start can be larger compared to potential energy of the ramp-started rollercoaster.

Accelerating the carts at the start of the ride has one strong disadvantage. The peak power of the launching system needs to be significantly higher than the average power that is needed for the rollercoaster. The needed power of the system to pull the carts to the top of the ramp can be low because the carts do not move at high speeds. In contrast to this giving the carts kinetic energy at the start demands a very high-powered launching system because the energy needs to be given to the carts in a very short time. During the remaining part of the ride this power is not used.

A need exists for a system that can accelerate the carts at the start of the rollercoaster ride, which does not have such a high peak-power demand, is simple, not expensive, has precise control possibilities and is easy to construct and maintain.

The present embodiments meet these needs.

BRIEF DESCRIPTION OF THE DRAWINGS

The present embodiments will be explained in greater detail with reference to the appended Figures, in which.

Figure 1:
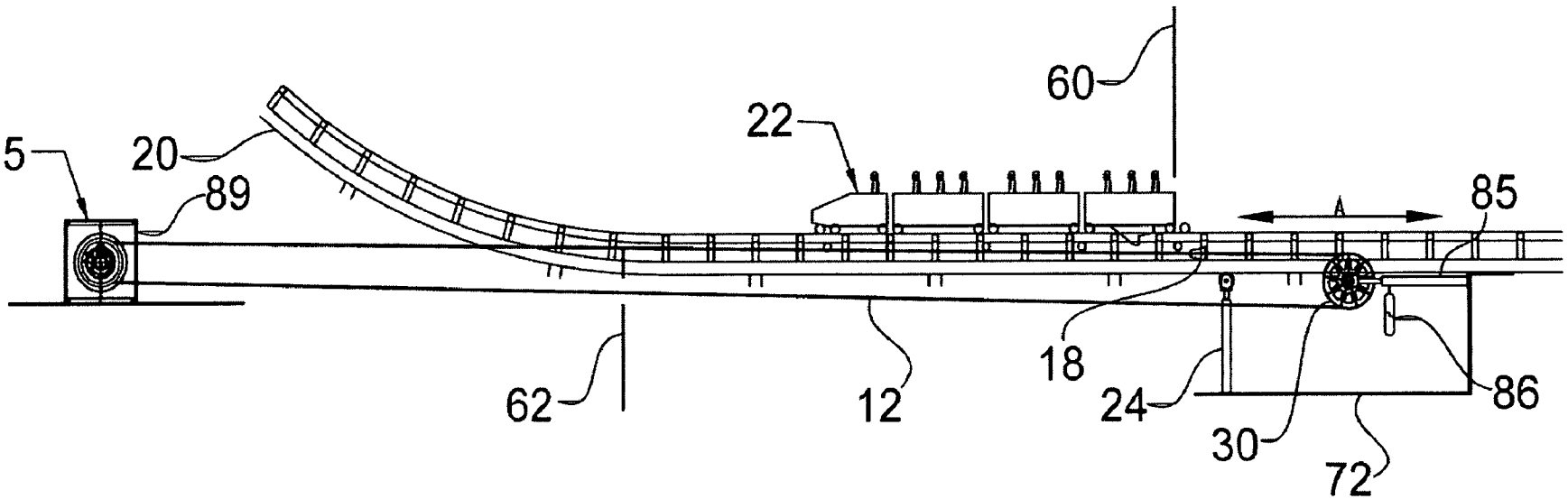
FIG. 1 depicts a side view of the rollercoaster launch system at the beginning of launch.

The present embodiments are detailed below with reference to the listed Figures.

DETAILED DESCRIPTION OF THE PREFERRED EMBODIMENTS

Before explaining the present embodiments in detail, it is to be understood that the embodiments are not limited to the particular embodiments herein and it can be practiced or carried out in various ways.

An object of the embodied systems is to provide a roller coaster launching system wherein the above-mentioned drawbacks are avoided at least to a considerable extent.

The basis of the launching system is formed by a secondary-controlled winch system. In a secondary-controlled winch system, the displacement of the hydro motor connected on one end to the winch drum is variable. The hydraulic motor is directly connected to the constant pressure circuit. The delivered torque and speed of the motor is controlled only with the variable displacement of the hydro motor. If the torque delivered by the motor is greater than the needed torque for the load, the motor hoists the load. If the torque delivered by the motor is less than the torque needed for the load, the load is lowered. To keep the load steady, the torque from the motor is kept in balance with the torque of the load. If more speed is needed, the displacement is slightly increased. For less speed, the displacement is slightly reduced. In this manner, precise control of the speed of the carts during the launching phase is possible. The motors can be driven by the HPU (Hydraulic Power Unit) high-pressure pump that maintains a constant pressure at the high-pressure circuit. Typically, this constant pressure is 270 psi, but other pressures can be used as well.

In the launch system, the primary task of the high-pressure pump is to fill the accumulators in the time between two launches. For the launch itself, a very high flow with a high pressure is needed for a short period. The accumulator capacity is calculated in such a way that the volume of high-pressure oil needed during the launching phase is entirely supplied by this accumulator. The systems allow the launch system to operate with a small power supply compared to the energy demand during the launch.

The secondary controlled winch is chosen because of the high accuracy and fast response of controlling the motors and the possibility to store energy. Responses of the system are very fast and acceleration of the hydraulic motor from zero to maximum speed can be obtained within 100 milliseconds.

Although the external power demand of the launching system is low the hydro motors driving the winch do need to provide this high power to the winch system. Large hydro motors are expensive. Therefore, a booster system can be attached to the launching system when very high launching speeds or very heavy carts are used. This booster system comprises a set of cylinders, which through sheaves and cables can exert an additional force on the carts. Compared to hydro motors hydraulic cylinders cost significantly less leading to a less expensive and simpler launching system.

With reference to the figures, FIG. 1 depicts a side view of the rollercoaster launch system at the beginning of launch. The launching system comprises a gripping conus (18) fixably connected to connecting wire (12). The gripping conus (18) can be a plate, a conus, a box, or any other functional geometrical shape. A connecting wire (12) is connected to winch system (5) located in a standard container (89) and is connected to a turning sheave (30), thereby forming a closed loop. The connecting wire can be in the form of a belt with teeth. A lifting cylinder (24) is removably connected to the wire (12) at the upper end and fixably mounted on first base (72) at the lower end. The lifting cylinder (24) lifts the connecting wire (12) in a vertical direction in order to connect the gripping conus (18) to carts (22).

Constant tension on the connecting wire (12) is maintained by the tensioning cylinder (85) fixably connected to turning sheave (30) at the first end and fixably connected to first base (72) at the other end. A tensioning cylinder (85) is connected to the accumulator (86) in order to maintain the pressure in the cylinder at a constant value thus keeping a constant tension on the connection wire (12). The turning sheave (30) of launching system (8) can move in direction A to keep a constant tension on the connecting wire (12). The launching system (8) moves a series of rollercoaster carts (22) on rollercoaster tracks (20) from a start position (60) to an end position (62).

Figure 2:
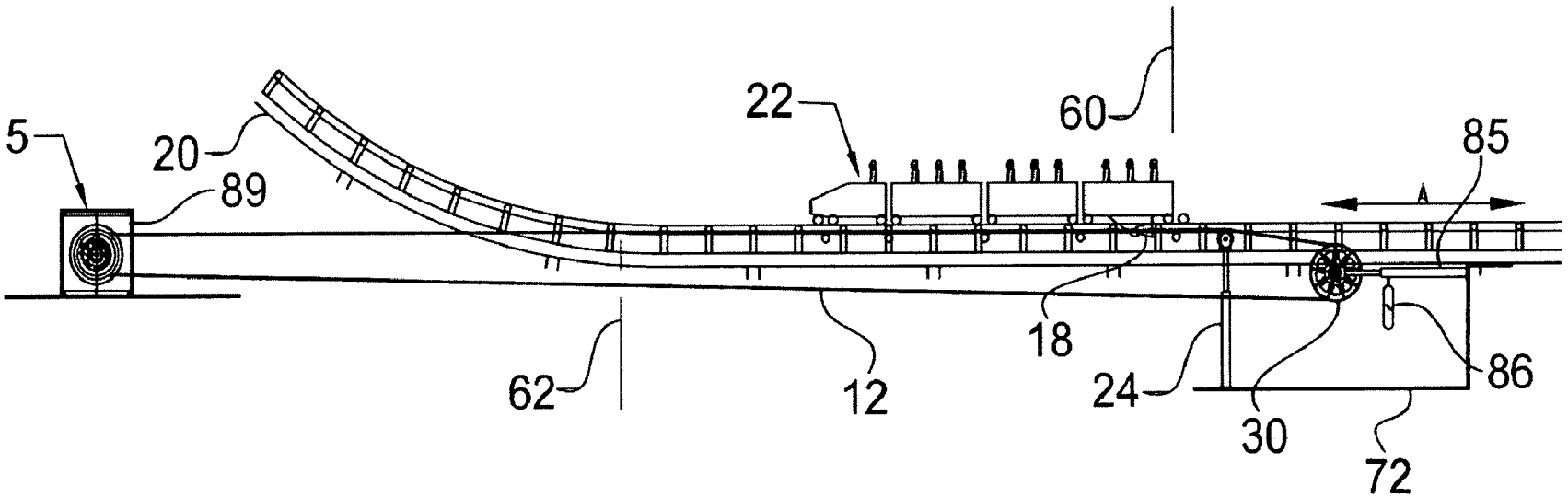
FIG. 2 depicts a side view of the rollercoaster launch system at the beginning of launch with the gripping conus attached to the carts.

FIG. 2 shows the elements of the rollercoaster launching system in FIG. 1 at the moment where the gripping conus (18) removably connects to carts (22) prior to the actual launch. By lowering connection wire (12), the carts (22) can move over the gripping conus (18) to reach the designated launching position (60).

Figure 3:
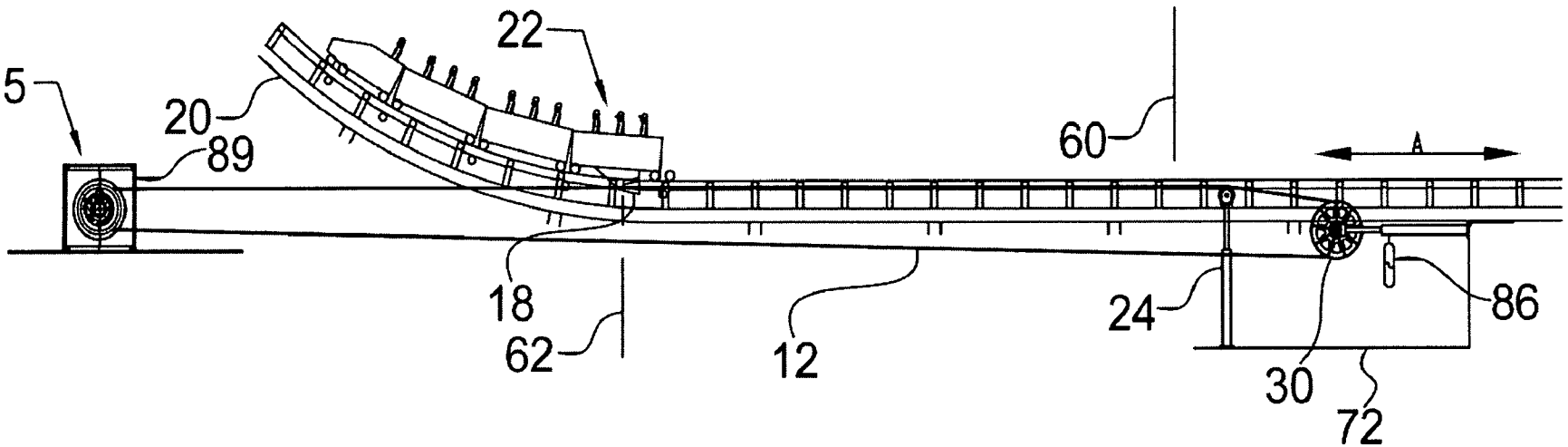
FIG. 3 depicts a side view of the rollercoaster launch system at the end of launch.

FIG. 3 shows the elements of the rollercoaster launching system in FIG. 1 after the launching sequence is completed and the series of rollercoaster carts (22) have passed the end position (62). After passing the end position (62), the gripping conus (18) automatically unlocks and is brought back to the starting position. Another set of carts can already be standing at the starting position ready for launching.

Figure 4:
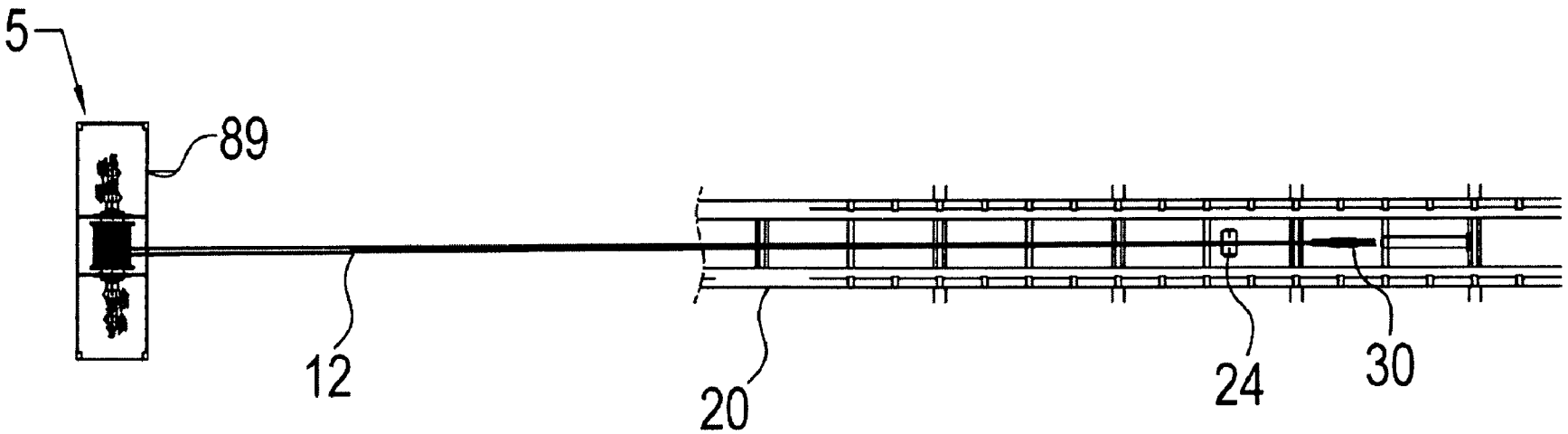
FIG. 4 depicts a top view of the rollercoaster launch system.

FIG. 4 is a top view of rollercoaster launching system (8). Again, FIG. 4 shows the connecting wire (12) connected to a winch system (5), a turning sheave (30), and a lifting cylinder (24). FIG. 4 shows the relationship of these elements to the rollercoaster track (20).

Figure 5:
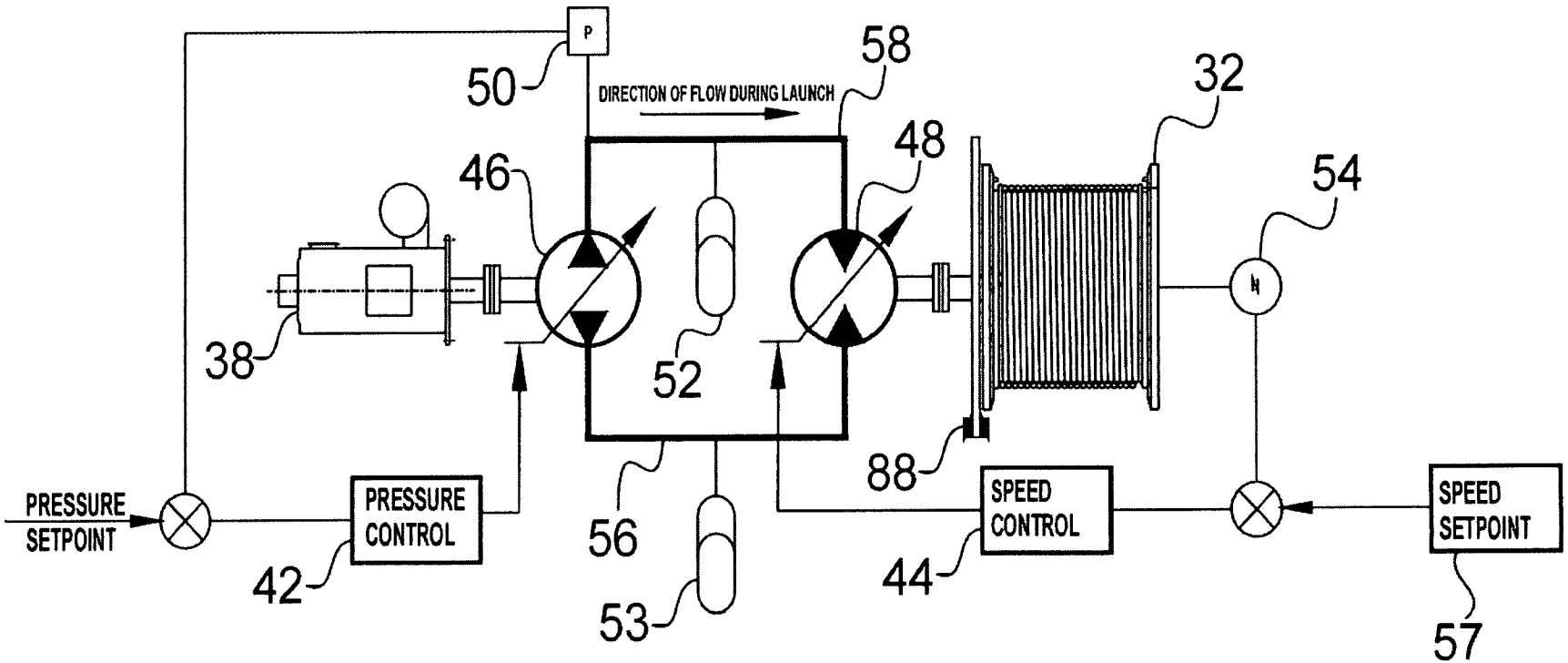
FIG. 5 is a schematic of the winch system for the rollercoaster launch system.

The secondary controlled winch system (5) shown in FIG. 1 is shown again schematically in FIG. 5. The winch system (5) comprises a hydraulic pump (46) driven by a motor (38) connected by a first pipe (56) and a second pipe (58) to an accumulator system (52) connected to a hydraulic motor (48) that drives a winch drum (32). A second accumulator system (53) can be added and connected to the second pipe (58) and the hydraulic motor (48). The winch drum is connected to the gripping conus (18) by means of connecting wire (12).

The hydraulic pump in the winch system has a controllably swash plate angle. Similarly, the hydraulic motor in the winch system has a controllably swash plate angle. The speed of motor (38) and the swash plate angle of hydraulic pump (46) in the winch system can be controlled by the pressure controller (42). The pressure controller (42), in turn, can be actuated based on the signal of a pressure sensor (50).

Continuing with FIG. 5, the speed sensor (54) measures the actual speed of the drum. The speed set point (57) is the desired speed. The signal to the speed control (44) is the difference between the speed set point (57) and the actual speed of the drum as measured by the speed sensor (54). The signal from the speed sensor (54) is combined with the signal from the speed set point. A speed controller (44) can control the swash plate angle of hydraulic motor (48). The speed controller (44), in turn, can be actuated based on a signal from a speed sensor (54). The motor (38) in the winch system can also be an electrical motor or a combustion engine. An electrical motor is shown in FIG. 5. The hydraulic fluid of the winch system can be oil-based fluids, water-based fluids, environmental friendly fluids, biodegradable fluids, or combinations thereof.

The attached winch drum (32) is connected to an independent braking system (88) to hold the winch drum if the pressure in the system drops or the hydraulic motor fails. The pressure in both pipe (58) and pipe (56) is preferably constant. The winch system (5) can be fixably mounted in a standard size container (89) that includes all controls and pressure vessels connected thereto. The connection wire (12) is connected to the winch system as shown.

The number of pumps and motors attached to winch system (5) may vary. The hydraulic pumps (46) can vary number between one and ten. Likewise the number of motors (48) can vary between one and ten. The number of motors, typically hydraulic variable speed motors, (48) can vary between one and four per winch drum (32). The motors can be hydraulic motors. The number of winch drums (32) can vary between one and six per winch system (8).

The size of accumulators (52) and (53) is calculated to be able to store enough energy to launch a complete set of carts adding enough energy to complete the ride. The launching system stores energy between launches, which can be used during the launchings. The advantage of this system is that large energy generators are not needed anymore and a relative small launching system remains. During launching the pressure on the high-pressure side drops. The pressure drops because of the release of energy from the high-pressure accumulators. In between launches, the hydraulic pump increases the high pressure to the set launching value. Since the time between launching is much longer than the launch time itself, the power of the hydraulic pump can be considerably lower than if the hydraulic pump is the launching pump. Consequently, the driving motor (38) and the related energy demand are very low compared to the maximum launching power.

In an alternative embodiment, a rollercoaster (1) with a launching system (8) can connects temporarily to a roller cart (22) that is moving on a track (20). The launching system (8) can act as an emergency brake for cart (22). The number of coupled carts (22) can vary between one and twenty-five. The number of launching systems (8) can vary between one and four per track (20).

Figure 6:
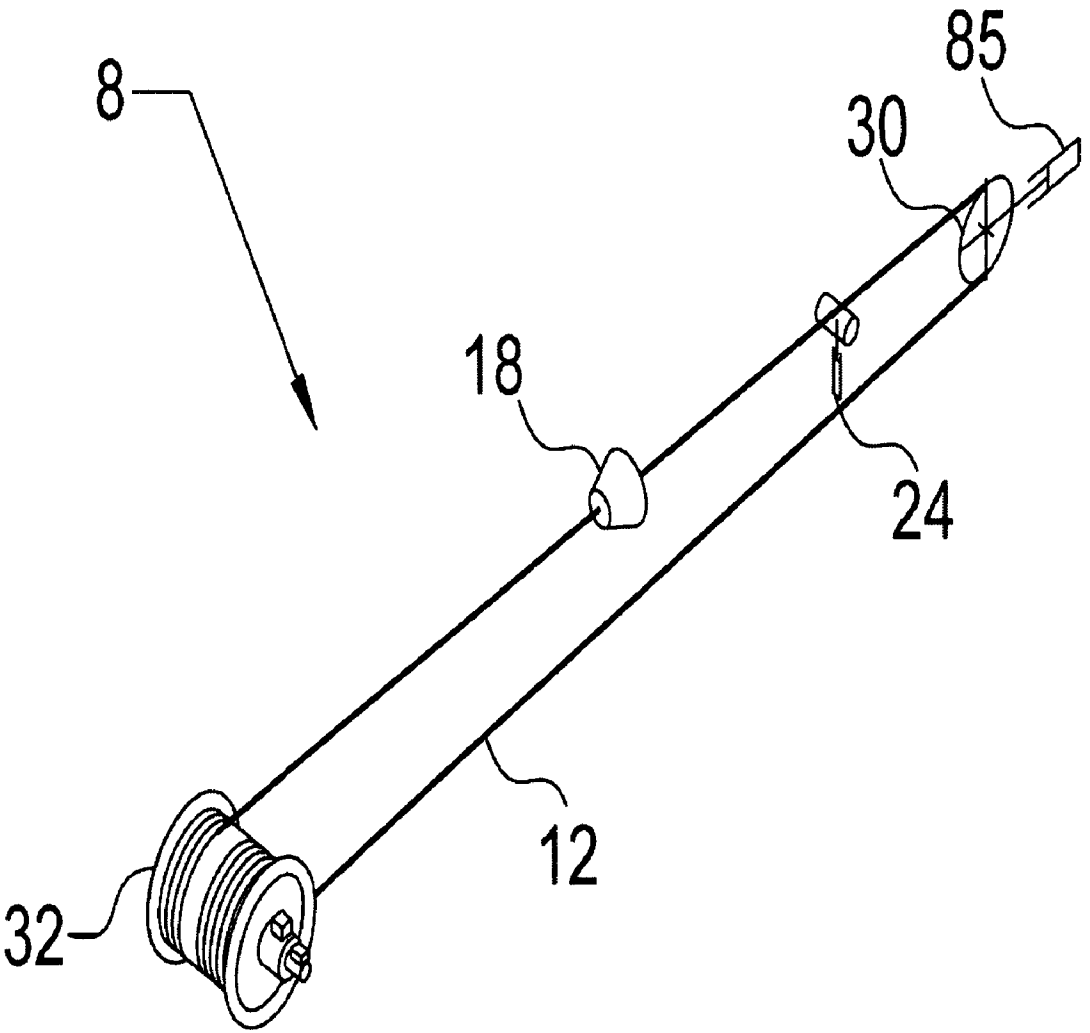
FIG. 6 depicts a perspective view of the launching system.

FIG. 6 shows a perspective view of launching system (8). FIG. 6 shows the launching system's (8) gripping conus (18) fixably connected to the connecting wire (12). FIG. 6 shows the connecting wire (12) connected to a winch system (5) and a turning sheave (30). A lifting cylinder (24) is removably connected to the wire (12) at the upper end and fixably mounted on a base (72). A booster system (9) is connected to the gripping conus (18). The wire (12) is connected to the winch drum (32). The lifting cylinder (24) can lift connecting wire (12) in a vertical direction.

Further, FIG. 6 shows constant tension on the connecting wire (12) is maintained by a tensioning cylinder (70) fixably connected to a turning sheave (70) at the first end and fixably connected to first base (72). The tensioning cylinder (70) can be connected to an accumulator (86) (See FIG. 1, FIG. 2, and FIG. 3) to maintain pressure in the cylinder at a constant value. The turning sheave (30) can move in the indicated direction to keep a constant tension on the connecting wire (12).

In some case, a booster system is needed to give the rollercoaster carts enough energy to complete the ride or to make certain loops and rolls possible within a given space limit. A second winch system can be installed, but a winch system is expensive. A small and inexpensive booster system is contemplated herein. This booster system comprises two sets of sheaves and a large cylinder. When the cylinder retracts, the space between the two sets of sheaves increases and the connecting wire moves. Since the wire is connected to the rollercoaster cart, the rollercoaster cart starts to move. To limit the stroke of the cylinder, the wire is wound several times around the set of sheaves. Typically for each sheave in each set, the stroke of the cylinder is multiplied by a factor two. When the cylinder is fully retracted after the launch of the rollercoaster cart, the cylinder has to return to the starting position for launching of the next set of rollercoaster carts. The booster system is designed in such a way that the force of the launching winch system is larger (during low speeds) than the force needed to extend the cylinder. In between the launches, the winch system extends the booster cylinder to a starting position. To keep a constant pressure on one side of the cylinder, the side is connected to a set of accumulators, which contain a gas, preferably nitrogen or another inert gas.

During the launch, the pressure will drop in the accumulators. The accumulators serve as energy storage that can be used during the launching phase. During the extension of the cylinder, the gas is flowing into the accumulator system thereby increasing the pressure in the accumulators and storing energy. The position of the cylinder is such that the cylinder is only loaded with tensile forces. With this placement, the size of the cylinder can be kept at a minimum value. After extension of the cylinder, a valve is closed between the accumulators and the cylinders. Due to the compressibility of the gas, the cylinder can or will move a short distance until there is equilibrium between the forces on both sides of the piston and the wire tension. Advantageously, the cylinder is able to move in extended position to keep a minimum tension on the wire. The valve can be a three-way valve so that when the accumulators are disconnected the cylinder is, at the same time, connected to the environment so that forces cannot act on the cylinder to prevent a launch by accident.

The launching system can have a booster system connected to the gripping conus. The booster system has a booster system cylinder connected to a booster system base on a first end and on a second end to the first set of sheaves. The second set of sheaves is connected to the booster system base. A wire is connected to gripping conus and the booster system base. By retracting booster cylinder, the spooled wire length between sheaves increases and gripping conus moves to winch drum. Effectively, the booster system creates an extra launching force on cart.

The booster system can be integrated into the rollercoaster launch system. The booster system comprises a cylinder movably mounted at a first end to a first base and a second end connected to a set of sheaves. The cylinder is connected to accumulator system. A wire runs over the first set and second set of sheaves and is connected on one end to base and on the other end to gripping conus. The accumulator system is separated from the cylinder by a closing valve. The number of sheaves in first set of sheaves can vary between one and ten. The number of sheaves in the second set of sheaves can vary between one and ten. The number of cylinders can vary between one and five.

In another embodiment of the booster system, the booster system comprises a cylinder medium separator between accumulator and cylinder. The medium separator fluid can be water, water based hydraulic fluid, oil-based hydraulic fluid, environmentally friendly hydraulic fluid, oil, and/or biodegradable hydraulic fluid. A closing valve can be added between the cylinder and the accumulator system to shut-off and separate respective parts. Also, a closing valve can be added between the cylinder medium separator and the cylinder. Finally, a multiple connecting valve can be added between the cylinder and the accumulator system.

The cylinder is typically fully retracted after launching carts. For a new launching procedure cylinder has to be extended to its starting position. The force that the winch system can exert on connection wire is larger than the force needed to extend the cylinder. By using winch system in reverse mode cylinder is extended. After extension of the cylinder the gripping conus is in starting position and after increasing the pressure in the accumulators to the starting value the launching system is ready to launch another cart.

Figure 7:
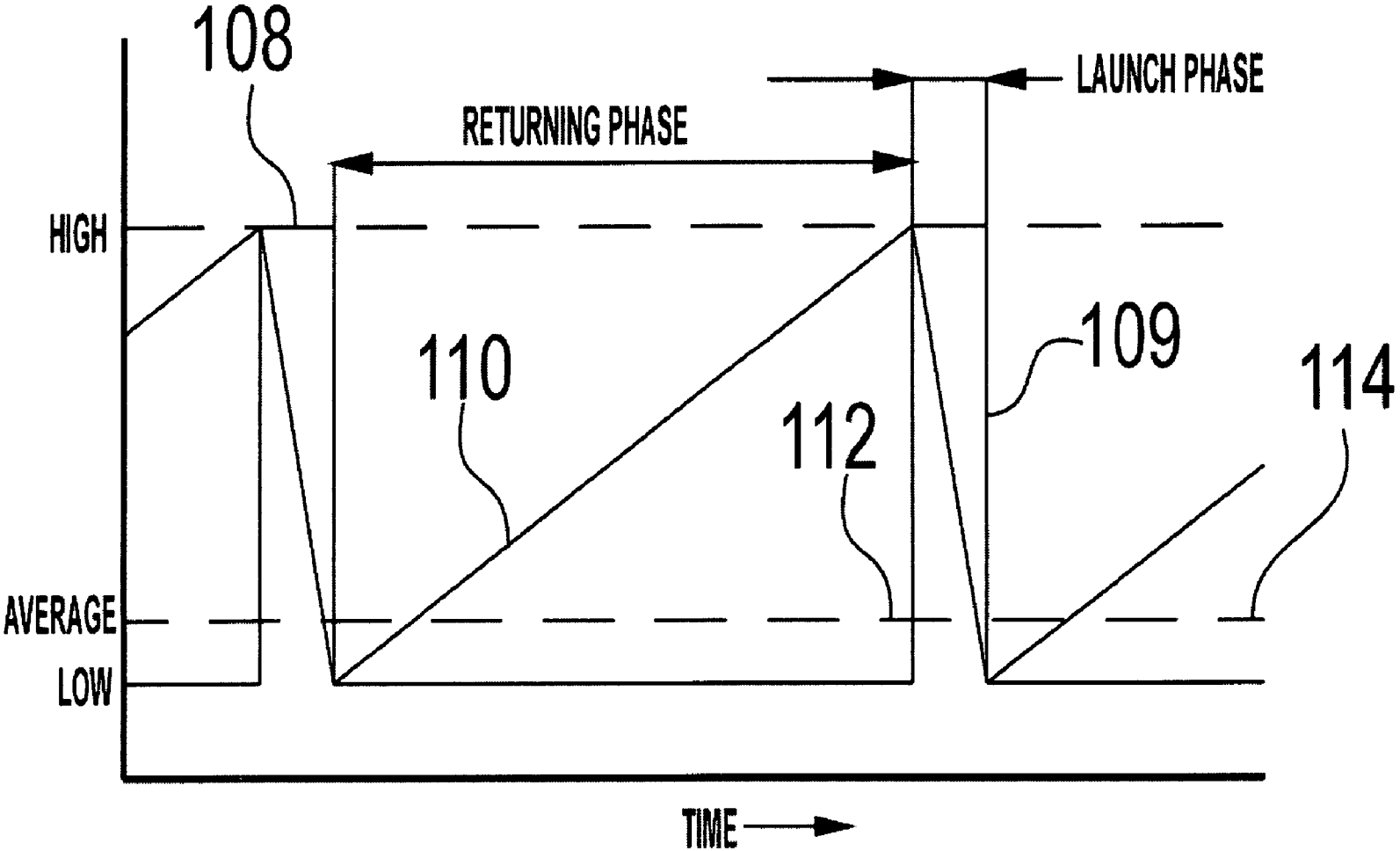
FIG. 7 is a graph showing the pressure levels associated with the rollercoaster launch system with relation to time.

FIG. 7 is a graph of the pressure (110) and power (109) levels from the start of the rollercoaster launching sequence to the returning phase in relation to time. High-level (108), low level (114) and average level (112) are marked on the graph as reference lines. The graph shows the pressure (110) experienced by the rollercoaster system during the start and returning sequences. During the launch phase the pressure drops in a short time to low level (114) and is increased to high level (109) in the returning phase during a much longer time. The external power demand of the winch system is the average value indicated on the figure as reference number 112. The internal power demand is indicated by reference line (109).

Figure 8:
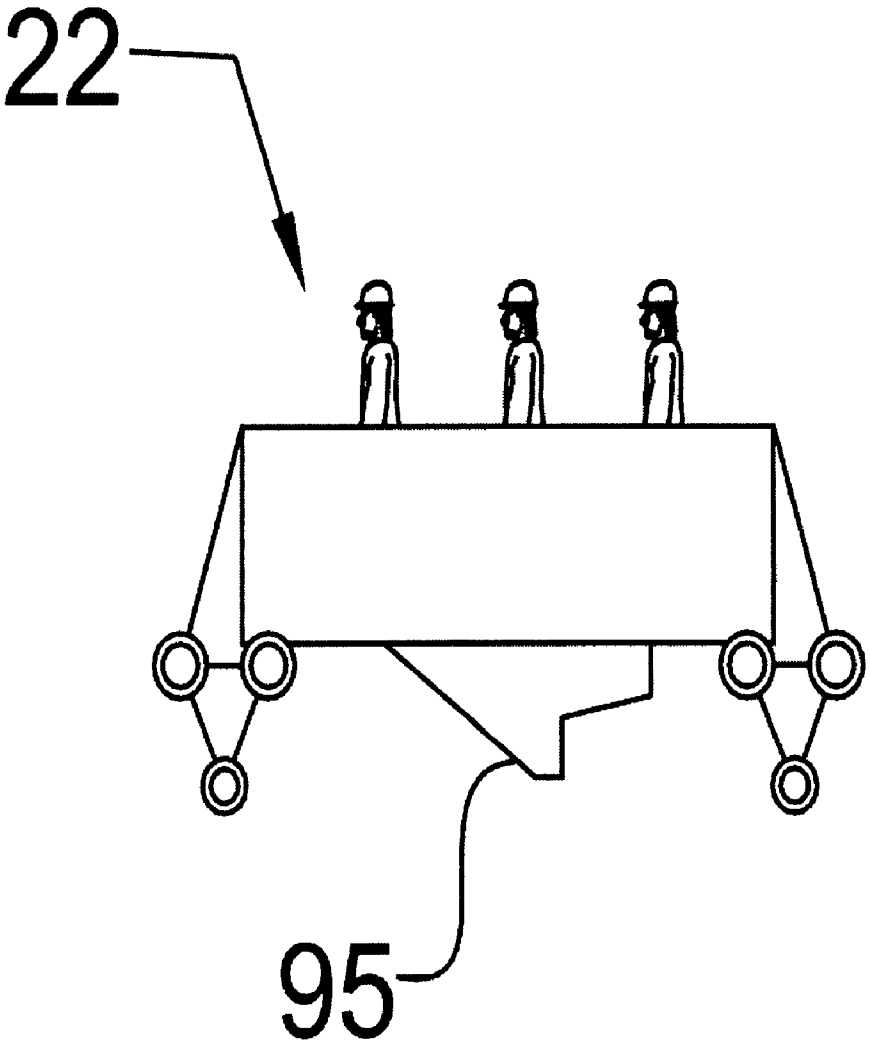
FIG. 8 depicts a side view of rollercoaster cart.

FIG. 8 shows the roller cart (22) for the rollercoaster launch system. In particular, FIG. 8 shows the receiving cone (95) connected to the underneath of the roller cart (22). The method of connecting cart (22) to connection wire (18) can be done with several other shapes and methods.

Figure 9:
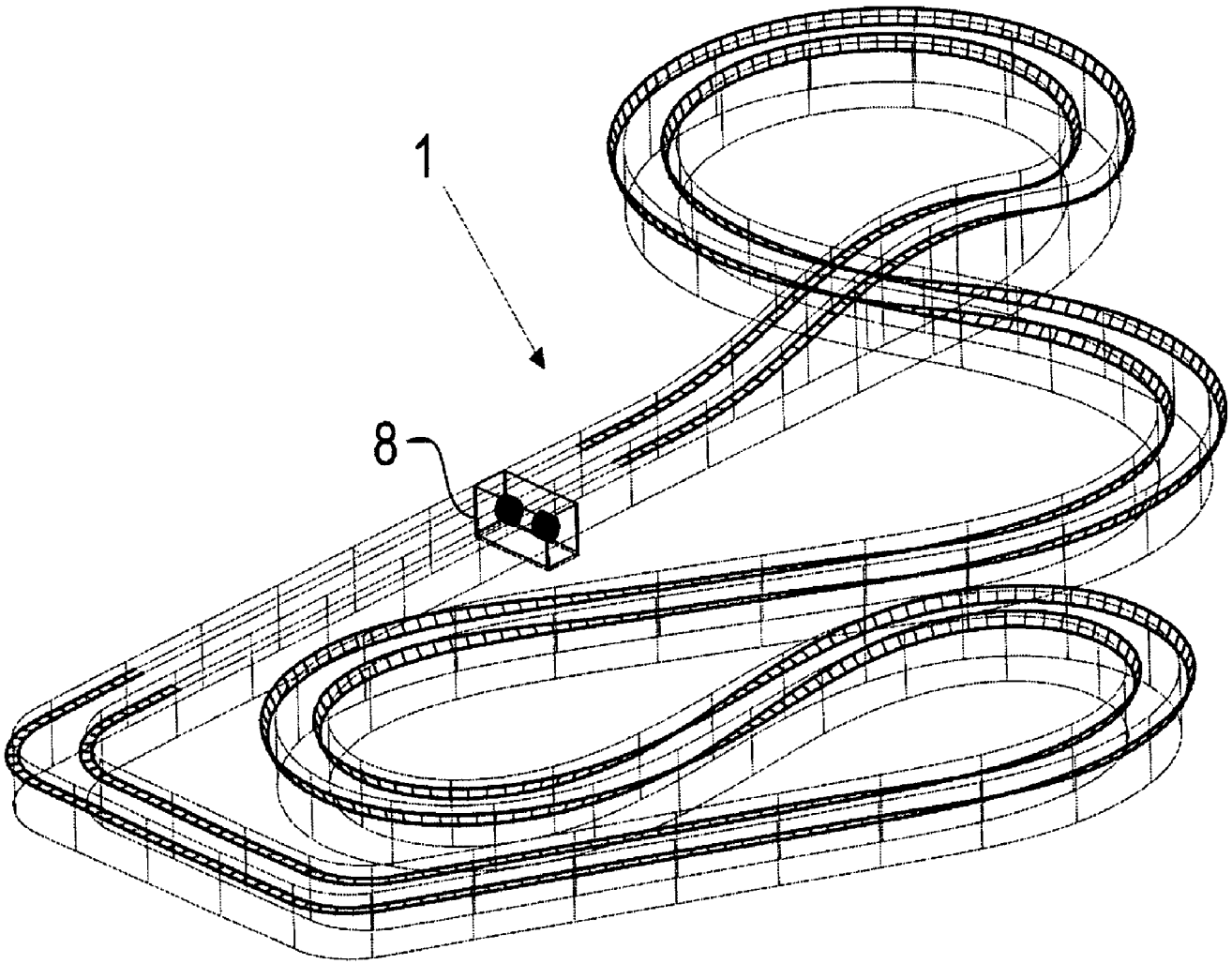
FIG. 9 depicts a perspective view of a rollercoaster track wherein the launching system is moving a series of carts up to a ramp.

FIG. 9 shows a perspective view of a rollercoaster (1) wherein launching system (8) is used to launch a series of carts up to a ramp. Giving the carts both kinetic and potential energy.

Figure 10:
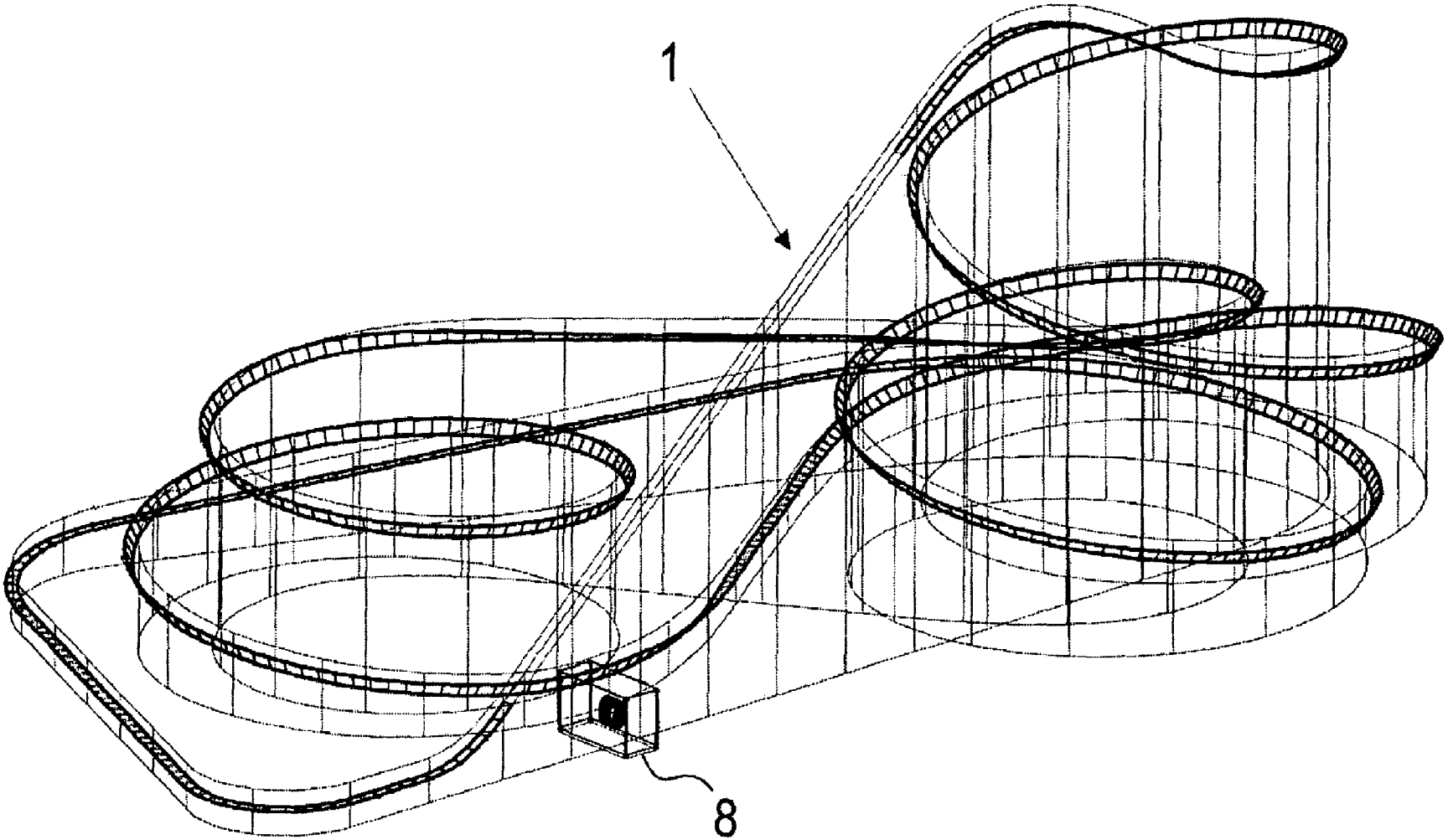
FIG. 10 depicts a perspective view of a rollercoaster track wherein the launching system is moving a series of cart horizontally.

FIG. 10 shows a perspective view of another embodiment of a rollercoaster (1) wherein launching system (8) launches the carts horizontally. Giving the carts only kinetic energy.

The launching system with booster system can include a valve located between accumulator and cylinder. The cylinder can connect volume to the accumulator system or the environment.

A method for launching a set of rollercoaster carts entails pressurizing a plurality of hydraulic accumulators in the a launching system; bringing a connecting conus (18) to its starting position; and lifting a connecting wire at its starting position (60).

The connecting cone (18) is connected to the receiving cone (95) and the hydraulic motor is energized, thereby speeding up the carts. The method continues by lowering the speed of the connection wire; disconnecting the connecting conus (18) and the receiving conus (95); and lowering the connecting wire (12). The method ends by returning connection conus (18) to the starting position and bringing forward another plurality of carts.

While these embodiments have been described with emphasis on the preferred embodiments, it should be understood that within the scope of the appended claims the embodiments might be practiced other than as specifically described herein.

What is claimed is:

1. A winch system comprising:

a. a hydraulic pump;

b. a variable speed motor connected to the hydraulic pump;

c. a first pipe connected to the hydraulic pump comprising a first pressurized fluid;

d. a second pipe connected to the hydraulic pump comprising a second pressurized fluid;

e. an accumulator system connected the first pipe and the second pipe;

f. a hydraulic motor connected to the accumulator system; and g. a winch drum connected to the motor.

2. The winch system of claim 1, wherein hydraulic pump comprises a controllably swash plate angle.

3. The winch system of claim 1, wherein motor comprises a controllably swash plate angle.

4. The winch system of claim 1, wherein the speed of the motor and a swash plate angle of the hydraulic pump are controlled by a pressure controller.

5. The winch system of claim 4, wherein the pressure controller is actuated based upon a signal from a pressure sensor.

6. The winch system of claim 1, wherein a speed controller controls a swash plate angle of the motor.

7. The winch system of claim 6, wherein the speed controller is actuated based on a signal from a speed sensor.

8. The winch system of claim 6, wherein the speed controller is actuated based a combined signal, wherein the combined signal is a first signal from a speed sensor and a second signal from a speed set point.

9. The winch system of claim 1, wherein the motor is a hydraulic motor, an electrical motor or a combustion engine.

10. The winch system of claim 9, wherein the hydraulic fluid of the winch drum is an oil-based fluid, a water-based fluid, an environmental friendly fluid, a biodegradable fluid, or combinations thereof.

11. The winch system of claim 1, further comprising an independent braking system connected to the winch drum.

12. The winch system of claim 1, wherein the first pressurized fluid in the first pipe is at a constant pressure.

13. The winch system of claim 1, wherein the second pressurized fluid in the second pipe at a constant pressure.

14. The winch system of claim 1, wherein the winch drum is fixably mounted in a standard size container.

15. The winch system of claim 1, further comprising a second accumulator connected to the second pipe and the motor.

16. The winch system of claim 1, comprising between one and ten hydraulic pumps.

17. The winch system of claim 1, comprising between one and ten motors.

18. The winch system of claim 1, wherein the motor comprises between one and four motors per winch drum.

19. The winch system of claim 1, wherein the number of winch drums varies between one and six.

* * * * *